US007926391B2

(12) United States Patent
Hu

(10) Patent No.: US 7,926,391 B2
(45) Date of Patent: Apr. 19, 2011

(54) SCREWDRIVER WITH RATCHET MECHANISM

(76) Inventor: Bobby Hu, Taichung (TW)

( * ) Notice: Subject to any disclaimer, the term of this patent is extended or adjusted under 35 U.S.C. 154(b) by 186 days.

(21) Appl. No.: 12/422,390

(22) Filed: Apr. 13, 2009

(65) Prior Publication Data

US 2009/0199683 A1 Aug. 13, 2009

Related U.S. Application Data

(63) Continuation-in-part of application No. 11/681,450, filed on Mar. 2, 2007, now abandoned.

(30) Foreign Application Priority Data

Apr. 18, 2006 (TW) ..... 95113847 A

(51) Int. Cl.
*B25B 15/04* (2006.01)

(52) U.S. Cl. ..... 81/63.1; 81/436

(58) Field of Classification Search ..... 81/60–63.2, 81/436; 192/43.1, 43.2
See application file for complete search history.

(56) References Cited

U.S. PATENT DOCUMENTS

| | | | | |
|---|---|---|---|---|
| 2,395,681 | A | 2/1946 | Odlum et al. | 192/43.2 |
| 4,458,795 | A | 7/1984 | Norton | 192/43.2 |
| 4,793,222 | A | 12/1988 | Beugelsdyk | 81/63.1 |
| 5,974,915 | A | 11/1999 | Chou | 81/63.1 |
| 6,047,802 | A | 4/2000 | Huang | 192/43.2 |
| 6,349,619 | B1 | 2/2002 | Liao | 81/62 |
| 7,174,810 | B1 | 2/2007 | Lin | 81/63.1 |
| 7,237,459 | B1 | 7/2007 | Shiao | 81/62 |
| 7,287,448 | B2 | 10/2007 | Hu | 81/60 |
| 7,380,482 | B1 | 6/2008 | Chan | 81/63.1 |
| 2002/0170392 | A1 | 11/2002 | Chen | 81/58.3 |
| 2006/0096422 | A1 | 5/2006 | Huang | 81/63.1 |
| 2007/0240544 | A1 | 10/2007 | Hu | 81/63.1 |

OTHER PUBLICATIONS

German Utility Model Publication No. 20213754 U1, Oct. 31, 2002, 22 pages.
German Utility Model Publication No. 202004019101 U1, Mar. 31, 2005, 15 pages.
Taiwanese Utility Model Publication No. M 269147, Jul. 1, 2005, 11 pages.
Taiwanese Utility Model Publication No. 369979, Sep. 11, 1999, 5 pages.
Taiwanese Utility Model Publication No. M 266134, Jun. 1, 2005, 9 pages.
Chinese Utility Model Publication No. 2504041Y, Aug. 7, 2002, 16 pages.

*Primary Examiner* — Hadi Shakeri
(74) *Attorney, Agent, or Firm* — Alan Kamrath; Kamrath & Associates PA

(57) ABSTRACT

A screwdriver includes a first body having an end for coupling with a handle, a second body rotatably coupled to the other end of the first body, two pairs of engaging members, and a switch member pivotably mounted to the first body. Each pair of engaging members is slidably received in an associated transverse receiving section that includes two end openings in an outer circumference of the first body. Each engaging member includes a first end with an engaging portion. An elastic element is mounted between second ends of each pair of engaging members for biasing the pair of engaging members away from each other. The switch member is pivotable to selectively engage at least one of the engaging portions of each pair of engaging members with teeth of the second body, thereby controlling relative rotation between the first body and the second body.

20 Claims, 6 Drawing Sheets

SCREWDRIVER WITH RATCHET MECHANISM

CROSS REFERENCE

The present application is a continuation-in-part application of U.S. patent application Ser. No. 11/681,450, filed on Mar. 2, 2007 now abandoned, of which the entire disclosure is incorporated herein.

BACKGROUND OF THE INVENTION

1. Field of the Invention

The present invention relates to a screwdriver. More particularly, the present invention relates to a screwdriver of the type with a ratchet mechanism allowing a change in the driving rotational direction for driving a screw and in a free rotational direction not driving the screw.

2. Description of the Related Art

U.S. Pat. No. 6,047,802 discloses a ratchet driving mechanism for a screwdriver. The ratchet driving mechanism includes a main body having two slots. A detent is received in each slot. The detents are selectively biased outward by springs to engage with teeth of a cylindrical rotary seat, thereby allowing a change in the driving rotational direction for driving a screw and in a free rotational direction not driving the screw. In manufacture, formation of the slots requires two elongate mold cores that are placed in a cavity of a mold. Since each slot does not extend through the main body, each mold core has an end unsupported in the cavity. When molten metal is filled into the cavity, the mold cores sway and wobble due to high temperature and high pressure in the mold such that errors are incurred in the specification of the slots. Namely, if the slots are not processed subsequently, the movement of the detents in the slots would not be smooth, leading to risks of getting stuck and malfunction. The cost is thus increased. Further, only two detents are used, and only one of them is engaged with the teeth of the cylindrical rotary seat such that the detent might slide relative to the teeth or the detent and/or the teeth might be damaged when a large torque is applied to the screwdriver. Hence, such a screwdriver can only be driven by a small torque, leading to limited application of the screwdriver, and if in any event a torque exceeds what the screwdriver can withstand, the detent which moved to a position in engagement with the teeth would be pushed out of the slot by the teeth.

U.S. Patent Application No. 2006/0096422 discloses a ratcheting mechanism for a driving tool. The ratcheting mechanism is utilized for permitting the driving tool to make a change in the driving rotational direction. The ratcheting mechanism includes two pairs of detents and each pair has a spring connected therebetween. The two pairs of detents are received in two spaces respectively defined in a driving member and each detent has one side abutted and supported by a wall of the space and an opposite side selectively engagable with a plurality of teeth defined in a control ring. Additionally, the control ring is rotatable and operably moves one of one pair of detents to a position in engagement with the teeth and has a stir bar that moves the other of one pair of detents to a position away from the teeth. Thus, when the driving tool is rotated in one driving direction two detents (i.e. upper left and bottom right or upper right and bottom left) would engage with the teeth at the same time, and this results that the driving tool is more capable of withstanding higher driving torque in comparison to the prior admitted invention. Further, while the two detents engage with the teeth, the other two detents are kept away from the teeth.

But, it is noticed that this invention has a practical difficulty because in operation when the control ring is rotated counterclockwise, the upper right and bottom left stir bars cause the upper right and bottom left detents to disengage or separate from the wall of the space and coact with the teeth, and even worse, after subsequent direction changes the detents will not mesh with the teeth correctly. Likewise, when the control ring is rotated clockwise, the upper left and bottom right stir bars would cause the upper left and bottom right detents to disengage from the wall of the space and coact with the teeth, leading to incorrect meshing after subsequent direction changes.

SUMMARY OF THE INVENTION

In accordance with a first aspect of the present invention, a screwdriver comprises a first body, a second body, two pairs of engaging members, and a switch member. The first body includes a first end and a second end. The first end of the first body is adapted for engaging with a handle. Two transverse receiving sections extend through the second end of the first body and each includes two end openings in an outer circumference of the first body, with the end openings being annular or in other words each end opening is formed by a channel having a closed cross-section. Further, each end opening is radially spaced from and transverse to the longitudinal axis of the first body.

The second body includes a first end and a second end. The first end of the second body includes a compartment. An inner circumference defining the compartment includes a plurality of teeth. The first end of the second body is rotatably mounted to the second end of the first body. The second end of the second body is adapted for coupling with a tool.

Each pair of engaging members is slidably received in an associated transverse receiving section. Each engaging member includes a first end with an engaging portion. Each engaging member further includes a second end. An elastic element is mounted between the second ends of each pair of engaging members for biasing the pair of engaging members away from each other.

The switch member is pivotably mounted to the first body. The switch member is pivotable to selectively urge at least one of each pair of the engaging members for selectively engaging at least one of the engaging portions of each pair of engaging members with the teeth of the second body, thereby controlling relative rotation between the first body and the second body.

Since the transverse receiving sections extend through the first body, two elongate mold cores can be placed into a cavity of a mold, with two ends of each elongate mold core being reliably supported by the mold without the risk of swaying or wobbling while forming the first body. Errors in the specification of the transverse receiving sections will not occur during manufacture, and subsequent processing of the transverse receiving sections is not required. A useful and inexpensive design is thus provided.

Further, since four engaging members are used to engage with the teeth of the second body, the screwdriver may bear higher torque during use.

Preferably, the transverse receiving sections are parallel to each other.

Preferably, the second end of the first body includes an annular groove in the outer circumference thereof. The inner circumference defining the compartment of the second body includes an annular groove. A retainer is partially received in the annular groove of the first body and partially received in the annular groove of the second body, allowing the first end of the second body to be rotatably mounted to the second end of the first body.

Preferably, the first body includes a receptacle. A positioning device is mounted in the receptacle. The switch member further includes at least two positioning grooves. The positioning device is selectively engaged in one of the positioning grooves. In an example, the switch member includes three positioning grooves.

Preferably, the positioning device includes a positioning member and an elastic element for biasing the positioning member into one of the positioning grooves.

Preferably, the first body further includes a recessed section having two ends. The switch member includes a protrusion abutting against one of the ends of the recessed section for preventing excessive rotation of the switch member.

Preferably, the second end of the second body further includes an engaging groove for coupling with a tool.

Preferably, the engaging portion of each engaging member includes a projection. The switch member includes two controlling sections each including two control grooves for respectively receiving the projections of an associated pair of engaging members. A wall defining each control groove of each controlling section presses against the projection of an associated one of the engaging members for disengaging the engaging portion of the associated one of engaging members from the teeth of the second body when the switch member is turned for changing relative rotational direction between the first body and the second body.

Preferably, the second end of each engaging member includes a restraining section for receiving an end of an associated elastic element.

Preferably, each engaging member is substantially U-shaped and includes two limbs defining the restraining section.

Preferably, the switch member is a ring mounted around the first body.

In accordance with a second aspect of the present invention, a screwdriver comprises a first body, a second body, two pairs of engaging members, a switch member, a positioning member, first and second elastic elements, and a third elastic element.

The first body includes a first end and a second end. The first end of the first body is adapted for engaging with a handle. Two transverse receiving sections extend through the second end of the first body and each includes two end openings in an outer circumference of the first body. The first body further includes a receptacle.

The second body includes a first end and a second end. The first end of the second body includes a compartment. An inner circumference defining the compartment includes a plurality of teeth. The first end of the second body is rotatably mounted to the second end of the first body. The second end of the second body is adapted for coupling with a tool.

Each pair of engaging members is slidably received in an associated one of the transverse receiving sections. Each engaging member includes a first end with an engaging portion. Each engaging member further includes a second end. The first and second elastic elements are mounted between the second ends of an associated pair of engaging members for biasing the associated pair of engaging members away from each other out of the associated transverse receiving section.

The switch member is pivotably mounted around the first body. The switch member includes three positioning grooves corresponding to three positions relative to the first body.

The positioning member is mounted in the receptacle and biased by the third elastic element into one of the positioning grooves, thereby retaining the switch member in one of the three positions.

When the switch member is in a first one of the three positions, the first body and the second body turn jointly when a rotational force is applied to the first body in a first direction, and the first body turns freely relative to the second body when a rotational force is applied to the first body in a second direction reverse to the first direction.

When the switch member is in a second one of the three positions, the first body and the second body turn jointly when a rotational force is applied to the first body in either one of the first direction and the second direction.

When the switch member is in a third one of the three positions, the first body and the second body turn jointly when a rotational force is applied to the first body in the second direction, and the first body turns freely relative to the second body when a rotational force is applied to the first body in the first direction.

Preferably, the second end of the first body includes an annular groove in the outer circumference thereof. The inner circumference defining the compartment of the second body includes an annular groove. A retainer is partially received in the annular groove of the first body and partially received in the annular groove of the second body, allowing the first end of the second body to be rotatably mounted to the second end of the first body.

Preferably, the first body includes a recessed section having two ends. The switch member includes a protrusion abutting against one of the ends of the recessed section for preventing excessive rotation of the switch member.

Preferably, the engaging portion of each engaging member includes a projection. The switch member includes two control sections each having a first control groove in which the projection of one of the associated pair of engaging members is received and a second control groove in which the projection of the other of the associated pair of engaging members is received.

When the switch member is in the first position, the projection of one of each pair of engaging members engages in the first control groove of an associated one of the control sections and the engaging portion of said one of each pair of engaging members engages with the teeth of the second body. Meanwhile, the projection of the other of each pair of engaging members disengages from the second control groove of the associated one of the control sections and the engaging portion of the other of each pair of engaging members disengages from the teeth of the second body.

When the switch member is in the second position, the projections of each pair of engaging members respectively engage in the first control groove and the second control groove of the associated one of the control sections, and the engaging portions of each pair of engaging members engage with the teeth of the second body.

When the switch member is in the third position, the projection of said one of each pair of engaging members disengages from the first control groove of the associated one of the control sections and the engaging portion of said one of each pair of engaging members disengages from the teeth of the second body. Meanwhile, the projection of the other of each pair of engaging members engages with the second control groove of the associated one of the control sections and the engaging portion of the other of each pair of engaging members engages with the teeth of the second body.

Preferably, the second end of engaging member includes a restraining section for receiving an end of an associated one of the first elastic elements.

Preferably, each engaging member is substantially U-shaped and includes two limbs defining the restraining section.

By such an arrangement, subsequent processing of the receiving section is not required while providing higher torque capacity.

Preferably, the transverse receiving sections are parallel to each other.

In accordance with a third aspect of the present invention, a screwdriver comprises a first body, a second body, two pairs of engaging members, a switch member, a positioning member, first and second elastic elements, and a third elastic element.

The first body includes a first end and a second end. The first end of the first body is adapted for engaging with a handle. Two transverse receiving sections extend through the second end of the first body and each includes two end openings in an outer circumference of the first body. The first body further includes a receptacle.

The second body includes a first end and a second end. The first end of the second body includes a compartment. An inner circumference defining the compartment includes a plurality of teeth. The first end of the second body is rotatably mounted to the second end of the first body. The second end of the second body is adapted for coupling with a tool.

Each pair of engaging members is slidably received in an associated transverse receiving section. Each engaging member includes a first end with an engaging portion. Each engaging member further includes a second end. The first and second elastic elements are mounted between the second ends of an associated pair of engaging members for biasing the associated pair of engaging members away from each other out of the associated transverse receiving section.

The switch member is pivotably mounted around the first body. The switch member includes at least two positioning grooves corresponding to at least two positions relative to the first body.

The positioning member is mounted in the receptacle and biased by the second elastic element into one of the positioning grooves, thereby retaining the switch member in one of the at least two positions.

When the switch member is in a first one of the at least two positions, the first body and the second body turn jointly when a rotational force is applied to the first body in a first direction, and the first body turns freely relative to the second body when a rotational force is applied to the first body in a second direction reverse to the first direction.

When the switch member is in a second one of the at least two positions, the first body and the second body turn jointly when a rotational force is applied to the first body in the second direction, and the first body turns freely relative to the second body when a rotational force is applied to the first body in the first direction.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
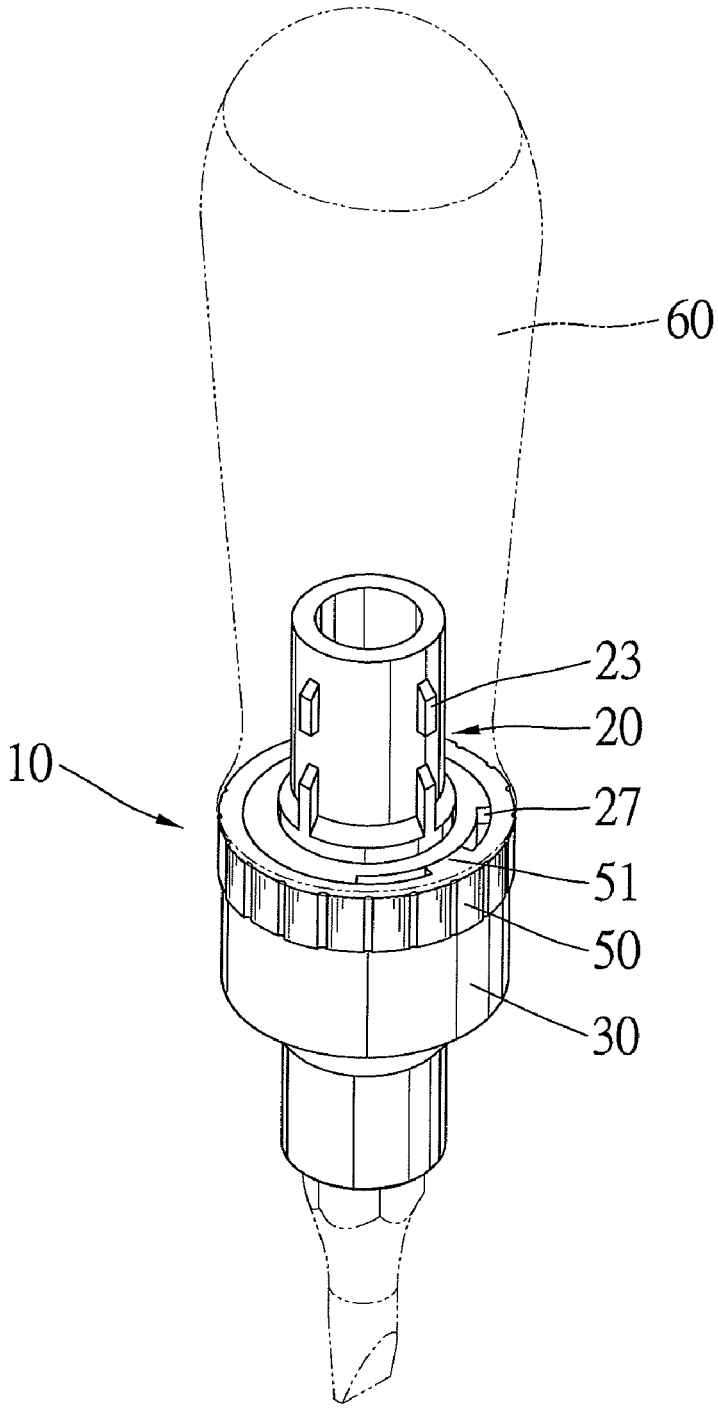
FIG. 1 is a perspective view of a screwdriver in accordance with the present invention.
Figure 2:
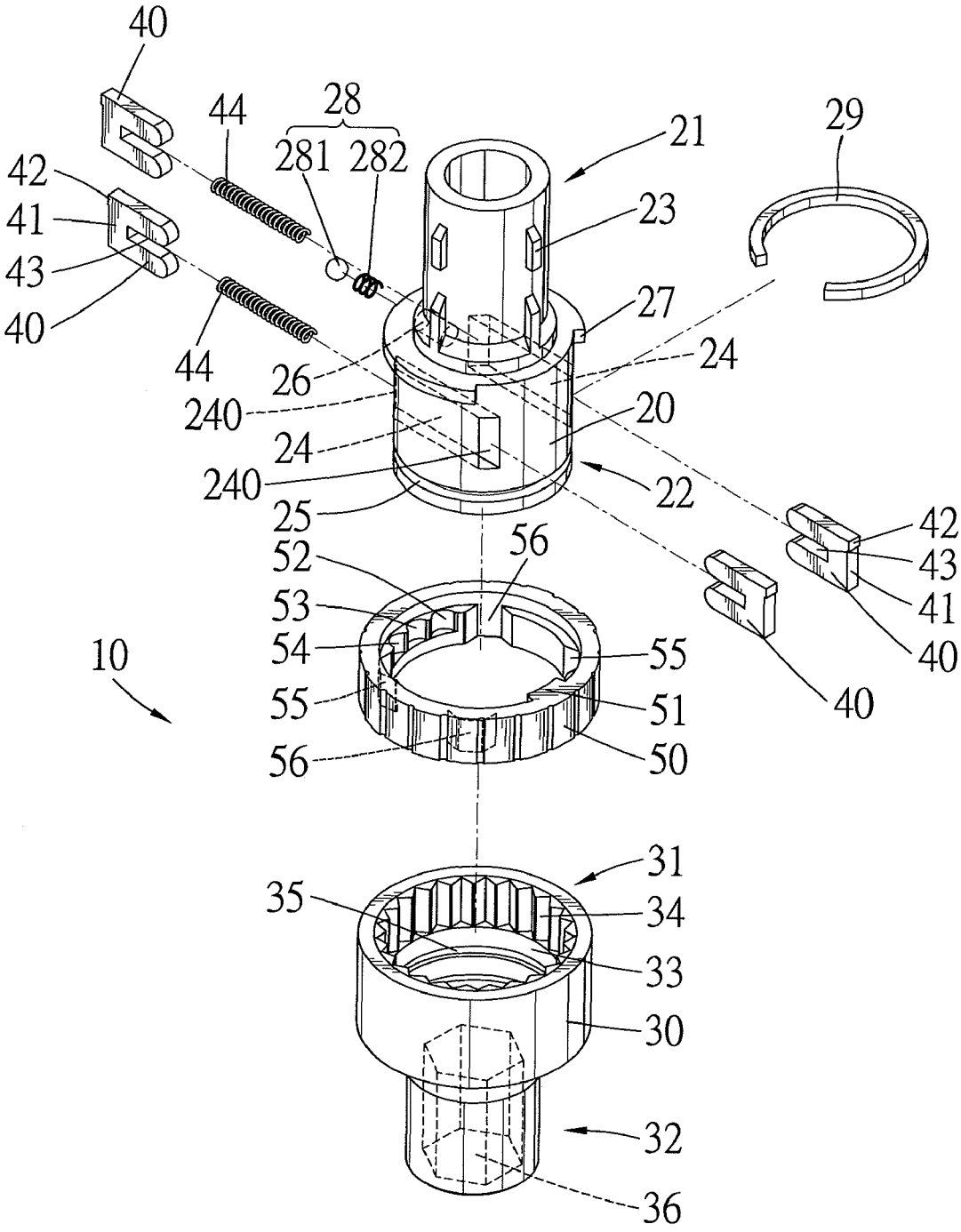
FIG. 2 is an exploded perspective view of the screwdriver in accordance with the present invention.

Referring to FIGS. 1 and 2, a screwdriver 10 in accordance with the present invention comprises a first body 20, a second body 30, two pairs of engaging members 40, and a switch member 50. The second body 30 is rotatably coupled to an end of the first body 20. The engaging members 40 are slidably mounted in the first body 20 and restrained and controlled by the switch member 50 pivotally mounted around the first body 20, thereby selectively restraining rotation of the second body 30.

More specifically, the first body 20 includes a first end 21 and a second end 22. A handle 60 is coupled to the first end 21 of the first body 20. Ribs or hooks 23 may be formed on the first end 21 of the first body 20 to avoid undesired detachment of the handle 60. Two transverse receiving sections 24 extend through the second end 22 of the first body 20 and each includes two end openings 240 in an outer circumference of the second end 22 of the first body 20, with the end openings 240 being annular or in other words each end opening 240 is formed by a channel having a closed cross-section. Further, each end opening 240 is radially spaced from and transverse to a longitudinal axis of the first body 20. Preferably, the transverse receiving sections 24 are parallel to each other. Also formed in the outer circumference of the second end 22 of the first body 20 is an annular groove 25 for receiving a portion of a retainer 29. The first body 20 further includes a receptacle 26 and a recessed section 27. A positioning device 28 is received in the receptacle 26 and includes a positioning member (such as a ball 281) and an elastic element 282 for biasing the ball 281 outward.

Since the transverse receiving sections 24 extend through the first body 20, two elongate mold cores (not shown) can be placed into a cavity (not shown) of a mold (not shown), with two ends of each elongate mold core being reliably supported by the mold without the risk of swaying or wobbling while forming the first body 20. Errors in the specification of the transverse receiving sections 24 will not occur during manufacture, and subsequent processing of the transverse receiving sections 24 is not required. A useful and inexpensive design is thus provided.

Figure 3:
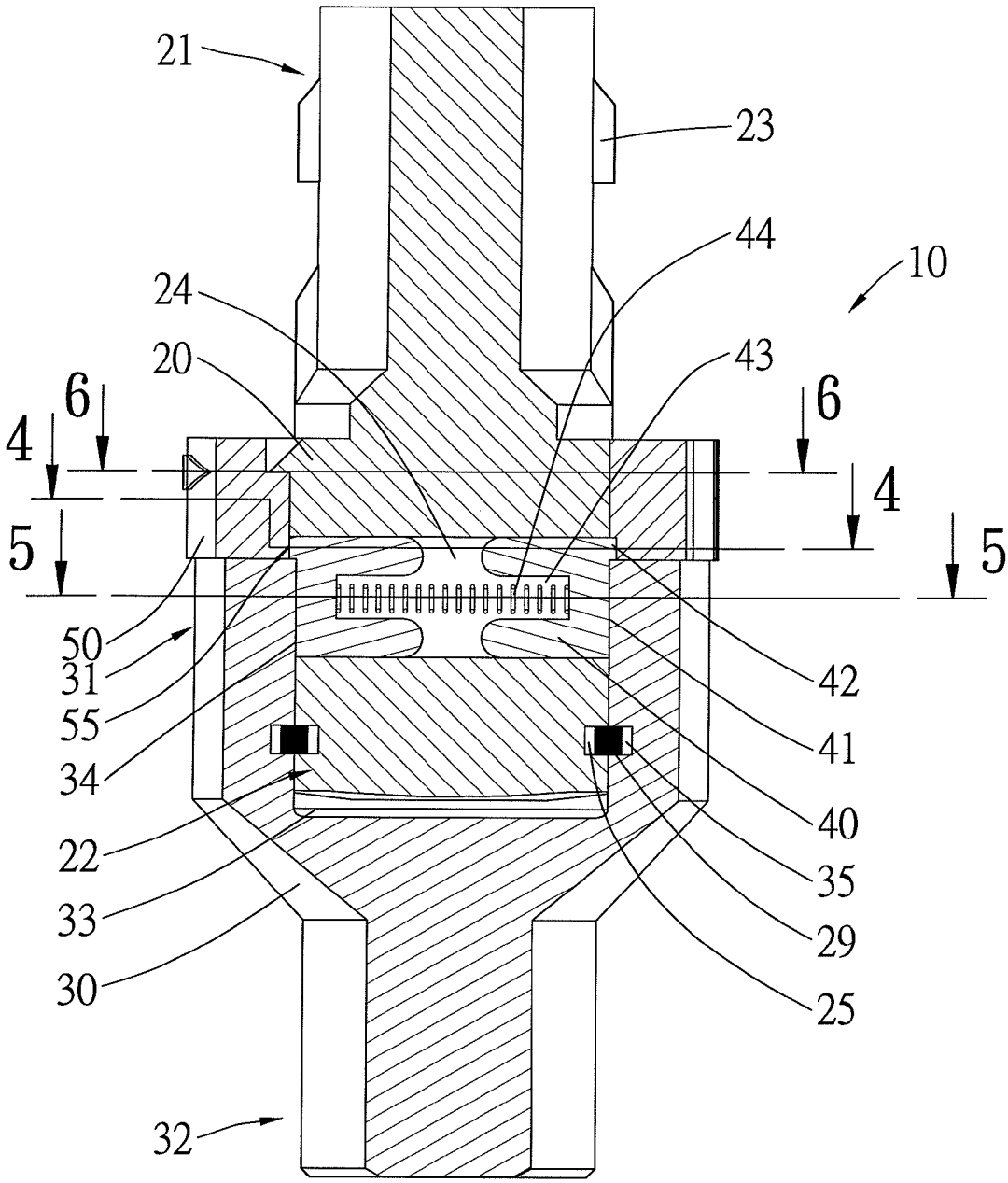
FIG. 3 is a longitudinal sectional view of the screwdriver in accordance with the present invention.

The second body 30 includes a first end 31 and a second end 32. A compartment 33 is defined in the first end 31 of the second body 30 for receiving the second end 22 of the first body 20. A plurality of teeth 34 and an annular groove 35 are formed on an inner circumference defining the compartment 33 of the second body 30. An engaging groove 36 is defined in the second end 32 of the second body 30 for coupling with a tool such as a bit (not shown) or the like. Referring to FIG. 3, the retainer 29 (a C-clip in this example) is partially received in the annular groove 25 of the first body 20 and partially received in the annular groove 35 of the second body 30. Thus, the first end 31 of the second body 30 is rotatably coupled to the second end 22 of the first body 20.

Each pair of engaging members 40 is slidably mounted in an associated transverse receiving section 24 of the first body 20. In this example, an end of each engaging member 40 includes an engaging portion 41 with a projection 42 for engaging with the teeth 34 of the second body 30. A restraining section 43 is provided on the other end of each engaging member 40, and an elastic element 44 is mounted between the restraining sections 43 of each pair of engaging members 40 for biasing the pair of engaging members 40 away from each other. In this example, each engaging member 40 is substantially U-shaped to form a restraining section 43 between two limbs (not labeled) thereof, and two ends of each elastic element 44 are respectively received in the restraining sections 43 of the associated pair of engaging members 40.

The switch member 50 in this example is substantially a ring pivotably mounted around the first body 20. A protrusion 51 is formed on an inner circumference of the switch member 50 and slidably engaged in the recessed section 27 of the first body 20. The inner circumference of the switch member 50 further includes three positioning grooves 52, 53, and 54 and two control sections each having a first control groove 55 and a second control groove 56.

Figure 4:
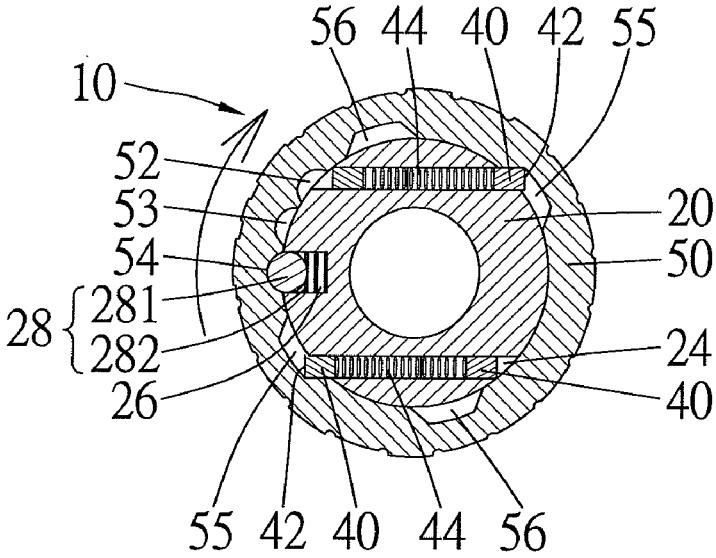
FIG. 4 is a sectional view taken along plane 4-4 in FIG. 3, wherein the switch member is in a first position.
Figure 5:
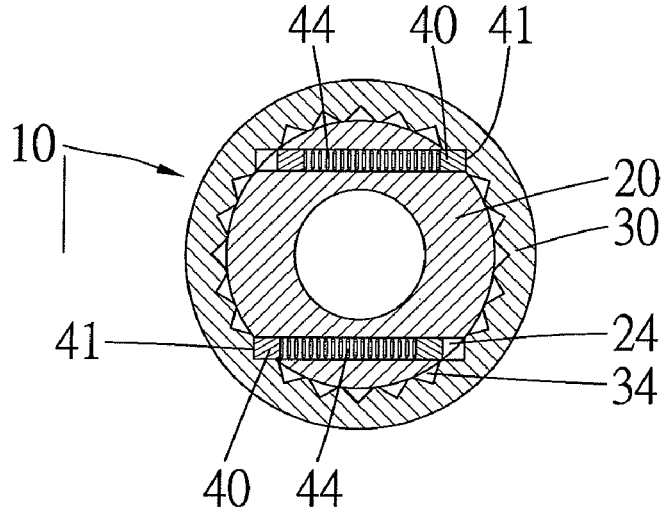
FIG. 5 is a sectional view taken along plane 5-5 in FIG. 3, illustrating engagement of one of two engaging members when the switch member is in the first position.
Figure 6:
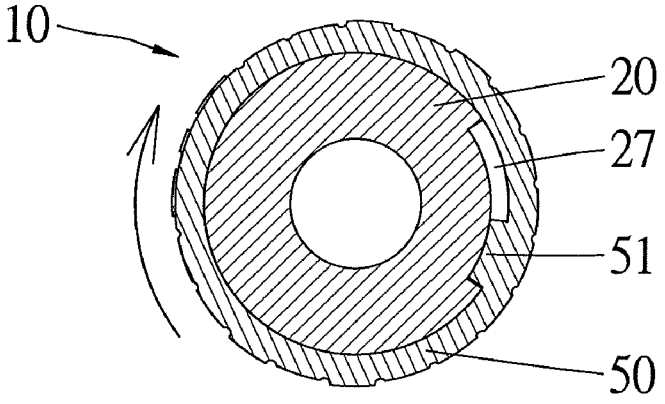
FIG. 6 is a sectional view taken along plane 6-6 in FIG. 3, illustrating the position of a protrusion of the switch member in the first position.

Referring to FIG. 4, when the switch member 50 is in a first position, the ball 281 of the positioning device 28 is biased by the elastic element 282 into the positioning groove 54 (the first positioning groove). One of each pair of engaging members 40 (the left one of the lower pair and the right one of the upper pair in FIG. 4) is engaged in the first control groove 55 of an associated control section whereas the other of each pair of engaging members 40 (the right one of the lower pair and the left one of the upper pair in FIG. 4) is disengaged from the second control groove 56 of an associated control section and retracted into the associated transverse receiving section 24 of the first body 20. Thus, the engaging portion 41 of the one of each pair of engaging members 40 (the left one of the lower pair and the right one of the upper pair in FIG. 5) is engaged with the teeth 34 of the second body 30. It is noted that a wall defining each first control groove 55 abuts against the projection 42 of the associated engaging member 40 (see FIG. 4). Meanwhile, the engaging portion 41 of the other of each pair of engaging members 40 (the right one of the lower pair and the left one of the upper pair in FIG. 5) is disengaged from the teeth 34 of the second body 30. It is noted that the projection 42 of the other of each pair of engaging members 40 is abutted against by the inner circumference of the switch member 50, not a wall defining the associated second control groove 56 (see FIG. 4). This allows the first body 20 to turn freely relative to the second body 30 in the clockwise direction. Further, referring to FIG. 6, the protrusion 51 of the switch member 50 abuts against an end of the recessed section 27 to avoid excessive rotation of the switch member 50. When the first body 20 is turned counterclockwise (e.g., a counterclockwise force is applied to the handle 60), the second body 30 is also turned counterclockwise to drive a screw or the like.

Figure 7:
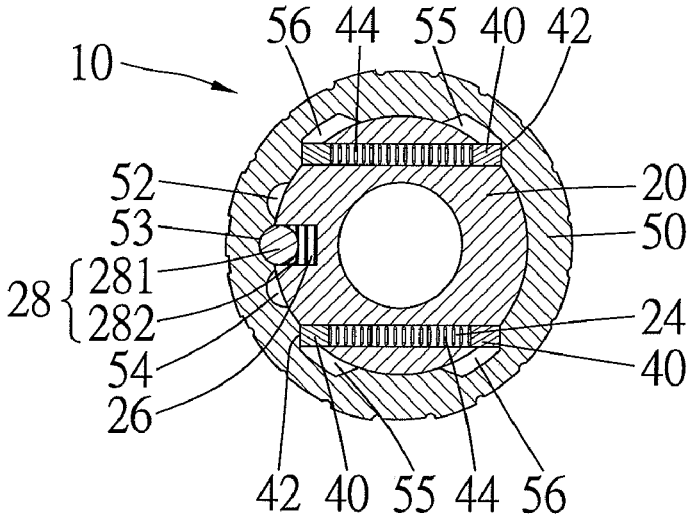
FIG. 7 is a view similar to FIG. 4, wherein the switch member is in a second position.
Figure 8:
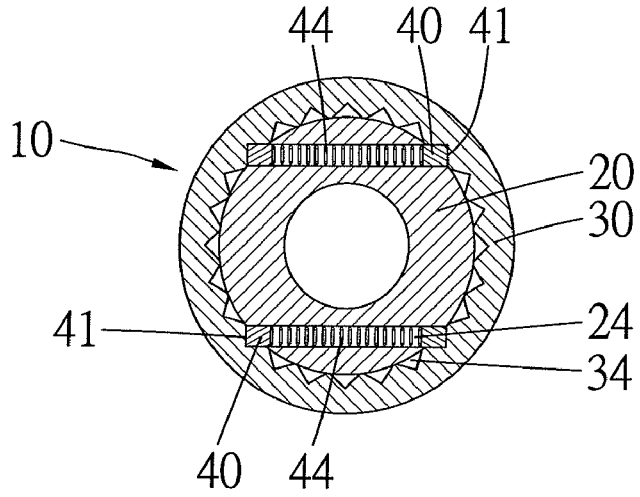
FIG. 8 is a view similar to FIG. 5, illustrating engagement of both engaging members when the switch member is in the second position.
Figure 9:
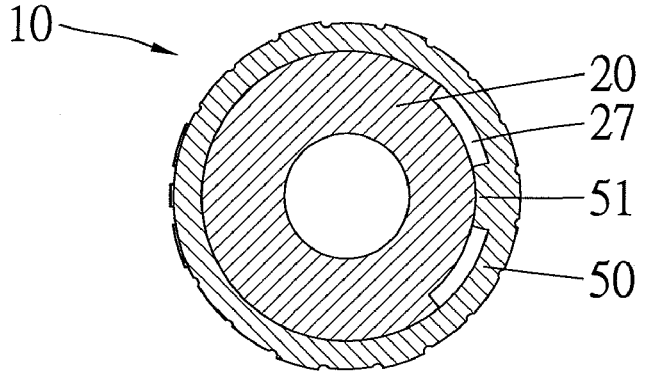
FIG. 9 is a view similar to FIG. 6, illustrating the position of the protrusion of the switch member in the second position.

Referring to FIG. 7, when the switch member 50 is turned to a second position, the ball 281 of the positioning device 28 is biased by the elastic element 282 into the positioning groove 53 (the second positioning groove). Each engaging member 40 is engaged in the associated control groove 55, 56. It is noted that the walls defining the control grooves 55 and 56 abut against the projections 42 of the associated engaging members 40, respectively. Thus, the engaging portion 41 of each engaging member 40 is engaged with the teeth 34 of the second body 30, as shown in FIG. 8. In this state, the first body 20 cannot turn freely relative to the second body 30 in either direction. Further, referring to FIG. 9, the protrusion 51 of the switch member 50 is in an intermediate portion of the recessed section 27. When the first body 20 is turned in either direction (e.g., a force is applied to the handle 60 in either direction), the second body 30 is also turned to drive a screw or the like.

Figure 10:
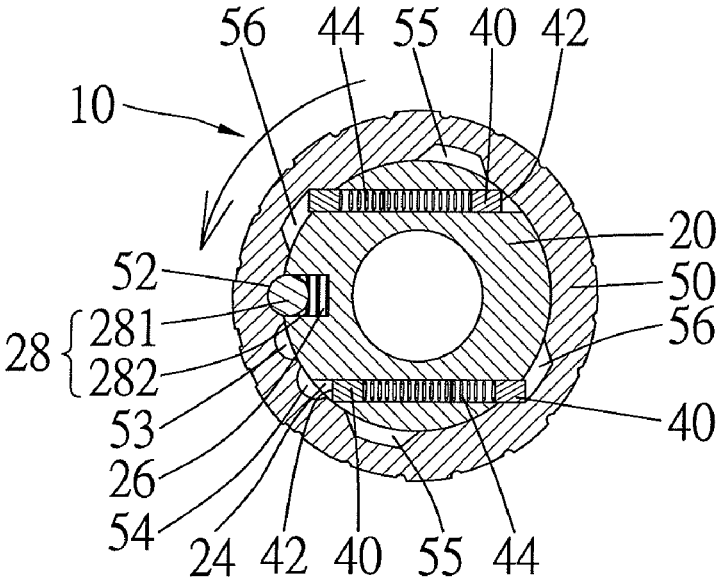
FIG. 10 is a view similar to FIG. 4, wherein the switch member is in a third position.
Figure 11:
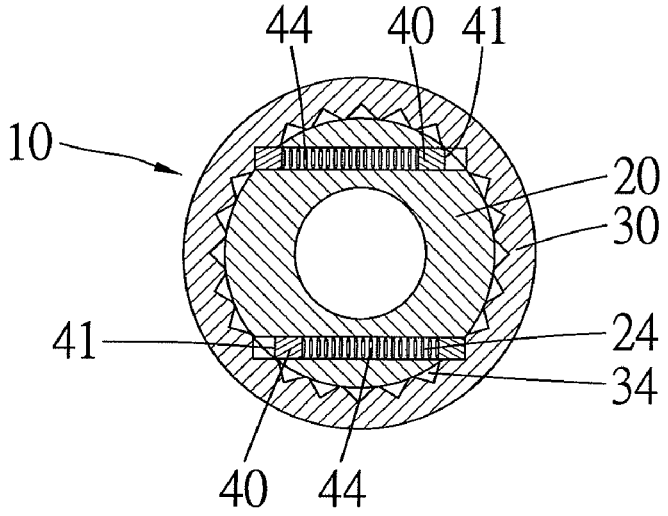
FIG. 11 is a view similar to FIG. 5, illustrating engagement of the other engaging member when the switch member is in the third position.
Figure 12:
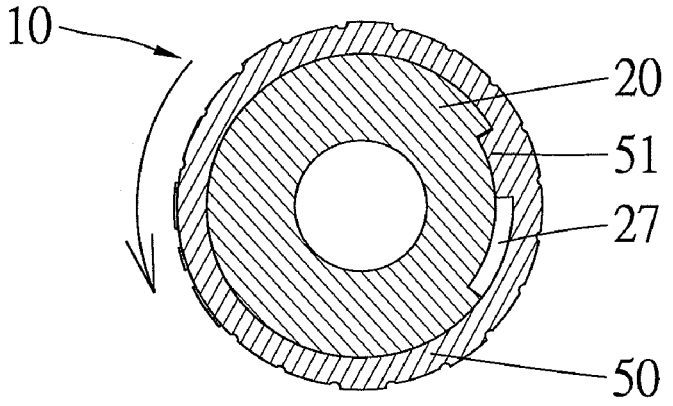
FIG. 12 is a view similar to FIG. 6, illustrating the position of the protrusion of the switch member in the third position.

Referring to FIG. 10, when the switch member 50 is in a third position, the ball 281 of the positioning device 28 is biased by the elastic element 282 into the positioning groove 52 (the third positioning groove). One of each pair of engaging members 40 (the right one of the lower pair and the left one of the upper pair in FIG. 10) is engaged in the second control groove 56 of the associated control section whereas the other of each pair of engaging members 40 (the left one of the lower pair and the right one of the upper pair in FIG. 10) is disengaged from the first control groove 55 of the associated control section and retracted into the associated transverse receiving section 24 of the first body 20. Thus, the engaging portion 41 of the one of each pair of engaging members 40 (the right one of the lower pair and the left one of the upper pair in FIG. 11) is engaged with the teeth 34 of the second body 30. It is noted that the wall defining each second control groove 56 abuts against the projection 42 of the associated engaging member 40. Meanwhile, the engaging portion 41 of the other of each pair of engaging members 40 (the left one of the lower pair and the right one of the upper pair in FIG. 11) is disengaged from the teeth 34 of the second body 30. It is noted that the projection 42 of the other of each pair of engaging members 40 is abutted against by the inner circumference of the switch member 50, not the wall defining the first control groove 55 of the associated control section. This allows the first body 20 to turn freely relative to the second body 30 in the counterclockwise direction. Further, referring to FIG. 12, the protrusion 51 of the switch member 50 abuts against the other end of the recessed section 27 to avoid excessive rotation of the switch member 50. When the first body 20 is turned clockwise (e.g., a clockwise force is applied to the handle 60), the second body 30 is also turned clockwise to drive a screw or the like.

It is noted that when the switch member 50 is turned for changing relative rotational directions between the first body 20 and the second body 30, the wall defining each control groove 55, 56 presses against the projection 42 of an associated one of the engaging members 40 for disengaging the engaging portion 41 of the associated one of the engaging members 40 from the teeth 34 of the second body 30 (see FIGS. 4, 7, and 10).

Conclusively, since the transverse receiving sections 24 extend through the first body 20, two elongate mold cores (not shown) can be placed into a cavity (not shown) of a mold (not shown), with two ends of each elongate mold core being reliably supported by the mold without the risk of swaying or wobbling while forming the first body 20. Errors in the specification of the transverse receiving sections 24 will not occur during manufacture, and subsequent processing of the transverse receiving sections 24 is not required. A useful and inexpensive design is thus provided.

Further, at least two engaging members 40 engage with the teeth 34 of the second body 30 at the same time, providing double engaging force for the first body 20 and the second body 30. Hence, the engaging members 40 would not slide relative to the teeth 34 of the second body 30 and the engaging members 40 and/or the teeth 34 of the second body 30 would not be damaged even though a large torque is applied to the screwdriver. This provides the screwdriver with high torque capacity and allows use by professional users.

Although specific embodiments have been illustrated and described, numerous modifications and variations are still possible without departing from the essence of the invention. The scope of the invention is limited by the accompanying claims.

What is claimed is:

1. A screwdriver comprising:

a first body including an outer circumference, a first end and a second end, the first end of the first body being adapted for engaging with a handle, first and second transverse receiving sections extending through the second end of the first body, with the first transverse receiving section parallel to and spaced from the second transverse receiving section, with the first and second transverse receiving sections each including first and second, annular, end openings in the outer circumference of the first body, with each end opening formed by a channel having a closed cross-section, and with each end opening radially spaced from and transverse to the longitudinal axis of the first body;

a second body including a first end and a second end, the first end of the second body including a compartment, an inner circumference defining the compartment including a plurality of teeth, the first end of the second body being rotatably mounted to the second end of the first body, the second end of the second body being adapted for coupling with a tool;

first and second pairs of engaging members slidably received in an associated one of the first and second transverse receiving sections, with each engaging member of the first and second pairs of engaging members including a first end with an engaging portion and including a second end;

a first elastic element mounted between the second ends of the engaging members of the first pair of engaging members biasing the engaging members of the first pair of engaging members away from each other;

a second elastic element mounted between the second ends of the engaging members of the second pair of engaging members biasing the engaging members of the second pair of engaging members away from each other, with one engaging member of the first pair of engaging members slideably extendable from the first end opening of the first transverse receiving section and another engaging member of the first pair of engaging members slideably extendable from the second end opening of the first transverse receiving section beyond the outer circumference of the first body, with one engaging member of the second pair of engaging members slideably extendable from the first end opening of the second transverse receiving section and another engaging member of the second pair of engaging members slideably extendable from the second end opening of the second transverse receiving section beyond the outer circumference of the first body, with the one engaging members of the first and second pairs of engaging members extending from the first end openings at the same time and the other engaging members of the first and second pairs of engaging members extending from the second end openings at the same time, with the other engaging members of the first and second pairs of engaging members remaining retracted from the second end openings and in the first and second transverse receiving sections when the one engaging members of the first and second pairs of engaging members are extended from the first end openings, with the one engaging members of the first and second pairs of engaging members remaining retracted from the first end openings and in the first and second transverse receiving sections when the other engaging members of the first and second pairs of engaging members are extended from the second end openings; and a switch member pivotably mounted to the first body with the first end of the second body being rotatably mounted to the second end of the first body, with the switch member being pivotable to selectively urge the one engaging members of the first and second pairs of engaging members to selectively engage the engaging portions of the one engaging members of the first and second pairs of engaging members with the plurality of teeth of the second body when the other engaging members of the first and second pairs of engaging members are retracted from the second end openings, with the switch member being pivotable to selectively urge the other engaging members of the first and second pairs of engaging members to selectively engage the engaging portions of the other engaging members of the first and second pairs of engaging members with the plurality of teeth of the second body when the one engaging members of the first and second pairs of engaging members are retracted from the first end openings, with the switch member preventing the other engaging members of the first and second pairs of engaging members from engaging the plurality of teeth when the one engaging members of the first and second pairs of engaging members are engaged with the plurality of teeth, with the switch member preventing the one engaging members of the first and second pairs of engaging members from engaging the plurality of teeth when the other engaging members of the first and second pairs of engaging members are engaged with the plurality of teeth, with the first and second pairs of engaging members controlling relative rotation between the first body and the second body.

2. The screwdriver as claimed in claim 1, with the second end of the first body including an annular groove in the outer circumference of the first body, with the first and second transverse receiving sections being spaced from the first end of the first body and the annular groove of the first body, with the inner circumference defining the compartment of the second body including an annular groove, with the annular groove of the inner circumference being intermediate to the plurality of teeth and the second end of the second body, with the screwdriver further including a retainer partially received in the annular groove of the first body and partially received in the annular groove of the second body allowing the first end of the second body to be rotatably mounted to the second end of the first body.

3. The screwdriver as claimed in claim 2, with the first body including a receptacle, with the screwdriver further including a positioning device mounted in the receptacle, with the switch member further including at least two positioning grooves, with the positioning device being selectively engaged in one of said at least two positioning grooves.

4. The screwdriver as claimed in claim 3, with the number of said at least two positioning groove is three.

5. The screwdriver as claimed in claim 3, with the positioning device including a positioning member and a third elastic element for biasing the positioning member into one of said at least two positioning grooves.

6. The screwdriver as claimed in claim 3, with the first body further including a recessed section having two ends, with the switch member including a protrusion abutting against one of the ends of the recessed section preventing excessive rotation of the switch member, with the recessed section being intermediate the first end of the body and the first and second transverse receiving sections, with the protrusion located intermediate the at least two positioning grooves and the first end of the first body when the switch member is pivotally mounted on the first body.

7. The screwdriver as claimed in claim 6, with the engaging portion of each engaging member of the first and second pairs of engaging members including a projection, with the switch member including two control grooves respectively receiving the projections of the engaging members of an associated one of the first and second pairs of engaging members, a wall defining each of the two control grooves pressing against the projection of an associated engaging member of the associated one of the first and second pairs of engaging members, with each of the two control grooves disengaging the engaging portion of the associated engaging member of the associated one of the first and second pairs of engaging members from the plurality of teeth of the second body when the switch member is turned for changing relative rotational directions between the first body and the second body, with the at least two positioning grooves being intermediate the projections of the engaging members and the protrusion of the switch member.

8. The screwdriver as claimed in claim 1, with the second end of the second body further including an engaging groove for coupling with a tool.

9. The screwdriver as claimed in claim 1, with the second end of each engaging member of the first and second pairs of engaging members including a restraining section receiving an end of an associated one of the first and second elastic elements.

10. The screwdriver as claimed in claim 9, with each engaging member of the first and second pairs of engaging members being substantially U-shaped and including two limbs defining the restraining section.

11. The screwdriver as claimed in claim 1, with the switch member being a ring mounted around the first body.

12. A screwdriver comprising:

a first body including an outer circumference, a first end and a second end, the first end of the first body being adapted for engaging with a handle, first and second transverse receiving sections extending through the second end of the first body, with the first transverse receiving section parallel to and spaced from the second transverse receiving section, with the first and second transverse receiving sections each including first and second, annular, end openings in the outer circumference of the first body, with each end opening formed by a channel having a closed cross-section, and with each end opening radially spaced from and transverse to the longitudinal axis of the first body, the first body further including a receptacle;

a second body including a first end and a second end, the first end of the second body including a compartment, an inner circumference defining the compartment including a plurality of teeth, the first end of the second body being rotatably mounted to the second end of the first body, the second end of the second body being adapted for coupling with a tool;

first and second pairs of engaging members slidably received in an associated one of the first and second transverse receiving sections, with each engaging member of the first and second pairs of engaging members including a first end with an engaging portion and including a second end;

a first elastic element mounted between the second ends of the engaging members of the first pair of engaging members biasing the engaging members of the first pair of engaging members away from each other out of the first transverse receiving section;

a second elastic element mounted between the second ends of the engaging members of the second pair of engaging members biasing the engaging members of the second pair of engaging members away from each other out of the second transverse receiving section, with one engaging member of the first pair of engaging members slideably extendable from the first end opening of the first transverse receiving section and another engaging member of the first pair of engaging members slideably extendable from the second end opening of the first transverse receiving section beyond the outer circumference of the first body, with one engaging member of the second pair of engaging members slideably extendable from the first end opening of the second transverse receiving section and another engaging member of the second pair of engaging members slideably extendable from the second end opening of the second transverse receiving section beyond the outer circumference of the first body, with the one engaging members of the first and second pairs of engaging members extending from the first end openings at the same time and the other engaging members of the first and second pairs of engaging members extending from the second end openings at the same time, with the other engaging members of the first and second pairs of engaging members remaining retracted from the second end openings and in the first and second transverse receiving sections when the one engaging members of the first and second pairs of engaging members are extended from the first end openings, with the one engaging members of the first and second pairs of engaging members remaining retracted from the first end openings and in the first and second transverse receiving sections when the other engaging members of the first and second pairs of engaging members are extended from the second end openings;

a switch member pivotably mounted around the first body with the first end of the second body being rotatably mounted to the second end of the first body, with the switch member being pivotable to selectively urge the one engaging members of the first and second pairs of engaging members to selectively engage the engaging portions of the one engaging members of the first and second pairs of engaging members with the plurality of teeth of the second body when the other engaging members of the first and second pairs of engaging members are retracted from the second end openings, with the switch member being pivotable to selectively urge the other engaging members of the first and second pairs of engaging members to selectively engage the engaging portions of the other engaging members of the first and second pairs of engaging members with the plurality of teeth of the second body when the one engaging members of the first and second pairs of engaging members are retracted from the first end openings, with the switch member preventing the other engaging members of the first and second pairs of engaging members from engaging the plurality of teeth when the one engaging members of the first and second pairs of engaging members are engaged with the plurality of teeth, with the switch member preventing the one engaging members of the first and second pairs of engaging members from engaging the plurality of teeth when the other engaging members of the first and second pairs of engaging members are engaged with the plurality of teeth, with the first and second pairs of engaging members controlling relative rotation between the first body and the second body, with the switch member including three positioning grooves corresponding to three positions relative to the first body;

a positioning member mounted in the receptacle; and a third elastic element biasing the positioning member into one of the three positioning grooves, with the positioning member retaining the switch member in one of the three positions;

wherein when the switch member is in a first one of the three positions, the first body and the second body turn jointly when a rotational force is applied to the first body in a first direction, and the first body turns freely relative to the second body when the rotational force is applied to the first body in a second direction reverse to the first direction, wherein when the switch member is in a second one of the three positions, the first body and the second body turn jointly when the rotational force is applied to the first body in either one of the first direction and the second direction; and wherein when the switch member is in a third one of the three positions, the first body and the second body turn jointly when the rotational force is applied to the first body in the second direction and the first body turns freely relative to the second body when the rotational force is applied to the first body in the first direction.

13. The screwdriver as claimed in claim 12, with the second end of the first body including an annular groove in the outer circumference of the first body, with the first and second transverse receiving sections being spaced from the first end of the first body and the annular groove of the first body, with the inner circumference defining the compartment of the second body including an annular groove, with the screwdriver further including a retainer partially received in the annular groove of the first body and partially received in the annular groove of the second body, allowing the first end of the second body to be rotatably mounted to the second end of the first body.

14. The screwdriver as claimed in claim 12, with the first body including a recessed section having two ends, with the switch member including a protrusion abutting against one of the ends of the recessed section for preventing excessive rotation of the switch member, with the recessed section being intermediate the first end of the body and the first and second transverse receiving sections, with the protrusion located intermediate the at least two positioning grooves and the first end of the first body when the switch member is pivotally mounted on the first body.

15. The screwdriver as claimed in claim 12, with the engaging portion of each engaging member of the first and second pairs of engaging members including a projection, with the switch member including two control sections each having a first control groove in which the projection of the one engaging member of the associated first and second pairs of engaging members is received and a second control groove in which the projection of the other engaging member of the associated first and second pairs of engaging members is received, wherein when the switch member is in the first position, the projection of one of the one engaging members of the first and second pairs of engaging members engages in the first control groove of an associated one of the two control sections and the engaging portion of said one of the one engaging members of the first and second pairs of engaging members engages with the plurality of teeth of the second body, the projection of one of the other engaging members of the first and second pairs of engaging members disengages from the second control groove of the associated one of the two control sections and the engaging portion of the one of the other engaging members of the first and second pairs of engaging members disengages from the plurality of teeth of the second body;

wherein when the switch member is in the second position, the projections of the engaging members of the first and second pairs of engaging members respectively engage in the first control groove of the associated one of the two control sections and the second control groove, and the engaging portions of the one engaging members of the first and second pairs of engaging members engage with the plurality of teeth of the second body; and wherein when the switch member is in the third one of the three positions, the projection of said one of the one engaging members of the first and second pairs of engaging members disengages from the first control groove of the associated one of the two control sections and the engaging portion of said one of the one engaging members of the first and second pairs of engaging members disengages from the plurality of teeth of the second body, the projection of the one of the other engaging members of the first and second pairs of engaging members engages with the second control groove of the associated one of the two control sections and the engaging portion of the one of the other engaging members of the first and second pairs of engaging members engages with the plurality of teeth of the second body.

16. The screwdriver as claimed in claim 15, with the first body including a recessed section having two ends, with the switch member including a protrusion abutting against one of the two ends of the recessed section preventing excessive rotation of the switch member, with the recessed section being intermediate the first end of the body and the first and second transverse receiving sections.

17. The screwdriver as claimed in claim 15, with the second end of each engaging member of the first and second pairs of engaging members including a restraining section receiving an end of an associated one of the first and second elastic elements.

18. The screwdriver as claimed in claim 12, with the second end of each engaging member of the first and second pairs of engaging members including a restraining section receiving an end of an associated one of the first and second elastic elements.

19. The screwdriver as claimed in claim 18, with each engaging member of the first and second pairs of engaging members being substantially U-shaped and including two limbs defining the restraining section.

20. A screwdriver comprising:

a first body including an outer circumference, a first end and a second end, the first end of the first body being adapted for engaging with a handle, first and second transverse receiving sections extending through the second end of the first body, with the first transverse receiving section parallel to and spaced from the second transverse receiving section, with the first and second transverse receiving sections each including first and second, annular, end openings in the outer circumference of the first body, with each end opening formed by a channel having a closed cross-section, and with each end opening radially spaced from and transverse to the longitudinal axis of the first body, the first body further including a receptacle;

a second body including a first end and a second end, the first end of the second body including a compartment, an inner circumference defining the compartment including a plurality of teeth, the first end of the second body being rotatably mounted to the second end of the first body, the second end of the second body being adapted for coupling with a tool;

first and second pairs of engaging members slidably received in an associated one of the first and second transverse receiving sections, with each engaging member of the first and second pairs of engaging members including a first end with an engaging portion and including a second end;

a first elastic element mounted between the second ends of the engaging members of the first pair of engaging members biasing the engaging members of the first pair of engaging members away from each other out of the first transverse receiving section;

a second elastic element mounted between the second ends of the engaging members of the second pair of engaging members biasing the engaging members of the second pair of engaging members away from each other out of the second transverse receiving section, with one engaging member of the first pair of engaging members slideably extendable from the first end opening of the first transverse receiving section and another engaging member of the first pair of engaging members slideably extendable from the second end opening of the first transverse receiving section beyond the outer circumference of the first body, with one engaging member of the second pair of engaging members slideably extendable from the first end opening of the second transverse receiving section and another engaging member of the second pair of engaging members slideably extendable from the second end opening of the second transverse receiving section beyond the outer circumference of the first body, with the one engaging members of the first and second pairs of engaging members extending from the first end openings at the same time and the other engaging members of the first and second pairs of engaging members extending from the second end openings at the same time, with the other engaging members of the first and second pairs of engaging members remaining retracted from the second end openings and in the first and second transverse receiving sections when the one engaging members of the first and second pairs of engaging members are extended from the first end openings, with the one engaging members of the first and second pairs of engaging members remaining retracted from the first end openings and in the first and second transverse receiving sections when the other engaging members of the first and second pairs of engaging members are extended from the second end openings;

a switch member pivotably mounted around the first body with the first end of the second body being rotatably mounted to the second end of the first body, with the switch member being pivotable to selectively urge the one engaging members of the first and second pairs of engaging members to selectively engage the engaging portions of the one engaging members of the first and second pairs of engaging members with the plurality of teeth of the second body when the other engaging members of the first and second pairs of engaging members are retracted from the second end openings, with the switch member being pivotable to selectively urge the other engaging members of the first and second pairs of engaging members to selectively engage the engaging portions of the other engaging members of the first and second pairs of engaging members with the plurality of teeth of the second body when the one engaging members of the first and second pairs of engaging members are retracted from the first end openings, with the switch member preventing the other engaging members of the first and second pairs of engaging members from engaging the plurality of teeth when the one engaging members of the first and second pairs of engaging members are engaged with the plurality of teeth, with the switch member preventing the one engaging members of the first and second pairs of engaging members from engaging the plurality of teeth when the other engaging members of the first and second pairs of engaging members are engaged with the plurality of teeth, with the first and second pairs of engaging members controlling relative rotation between the first body and the second body, with the switch member including at least two positioning grooves corresponding to at least two positions relative to the first body;

a positioning member mounted in the receptacle; and a third elastic element biasing the positioning member into one of the at least two positioning grooves, with the positioning member retaining the switch member in one of the at least two positions;

wherein when the switch member is in a first one of said at least two positions, the first body and the second body turn jointly when a rotational force is applied to the first body in a first direction and the first body turns freely relative to the second body when the rotational force is applied to the first body in a second direction reverse to the first direction; and wherein when the switch member is in a second one of said at least two positions, the first body and the second body turn jointly when the rotational force is applied to the first body in the second direction and the first body turns freely relative to the second body when the rotational force is applied to the first body in the first direction.

* * * * *